US005551146A

United States Patent [19]

Kawabata et al.

[11] Patent Number: 5,551,146

[45] Date of Patent: Sep. 3, 1996

[54] METHOD OF MANUFACTURING A SOLID INDUCTOR

[75] Inventors: Toshio Kawabata; Hiroyuki Takeuchi; Hisashi Katsurada; Kazutaka Nakamura; Tomoaki Ushiro, all of Nagaokakyo, Japan

[73] Assignee: Murata Manufacturing Co., Ltd., Japan

[21] Appl. No.: 288,588

[22] Filed: Aug. 10, 1994

Related U.S. Application Data

[62] Division of Ser. No. 909,595, Jul. 7, 1992, Pat. No. 5,359, 311.

[30] Foreign Application Priority Data

Jul. 8, 1991 [JP] Japan ..... 3-194939

[51] Int. Cl.[6] ..... H01F 41/02

[52] U.S. Cl. ..... 29/608; 29/602.1; 336/83; 336/233

[58] Field of Search ..... 29/602.1, 605, 29/606, 608; 336/83, 200, 233, 175

[56] References Cited

U.S. PATENT DOCUMENTS

| | | | |
|---|---|---|---|
| 2,457,806 | 1/1949 | Crippa | 336/83 |
| 2,966,704 | 1/1961 | O'Brian et al. | 336/83 |
| 3,068,433 | 12/1962 | Wroblewski | 336/83 |

FOREIGN PATENT DOCUMENTS 2288307 11/1990 Japan .

*Primary Examiner*—Carl E. Hall

*Attorney, Agent, or Firm*—Ostrolenk, Faber, Gerb & Soffen, LLP

[57] ABSTRACT

In A method of manufacturing a solid inductor having an inner conductor formed by passing through a magnetic, material. A vitreous diffused material is applied to the surface of the magnetic material, and the diffused material is diffused into the magnetic material by heat treatment, to form a diffusion layer exhibiting low permeability. The thickness of this diffusion layer is adjusted, thereby to make it possible to adjust the inductance value of the solid inductor as well as to improve resistance to humidity of the solid inductor.

13 Claims, 4 Drawing Sheets

METHOD OF MANUFACTURING A SOLID INDUCTOR

This is a division of application Ser. No. 07/909,595, filed Jul. 7, 1992, now U.S. Pat. No. 5,359,311.

BACKGROUND OF THE INVENTION

1. Field of the Invention

The present invention relates generally to solid inductors, and more particularly, to a chip inductor, whose inductance value can be adjusted, using a ceramic magnetic material.

2. Description of the Related Art

A solid inductor formed by passing an inner conductor through a magnetic material such as Ni—Zn ferrite has been conventionally known. This solid inductor is fabricated by forming by the printing process or the like inner electrodes made of Ag, Ag—Pd or the like on green sheets formed by the Doctor blade process or the like, and laminating the green sheets, followed by cofiring.

Examples of a method of adjusting the inductance value of such a solid inductor so as to be lower include a method of subjecting a chip inductance element to laser irradiation or machining to cut a part thereof.

Furthermore, examples of a method of adjusting the inductance value of such a solid inductor so as to be higher include a method of applying paste made of ferrite to the periphery of a chip inductance element to increase the volume of a magnetic material.

However, the solid inductor whose inductance value is adjusted in each of the above described methods has the disadvantage in that the shape thereof is changed from the shape of the solid inductor before the adjustment, so that the treatment thereof is complicated. In addition, it also has the disadvantage in that large numbers of solid inductors cannot be produced in each of the above described methods, to raise costs.

Additionally, in the conventional solid inductor, the inner electrodes are formed on the green sheets by the printing process or the like, and the green sheets are laminated, followed by cofiring, as described above. Accordingly, the sintering temperature must be significantly lower than that of the conventional ferrite core, so that the density of a sintered body becomes low depending on materials used. Consequently, the solid inductor is inferior in resistance to humidity. Therefore, the conventional solid inductor has the disadvantage in that when a magnetic material after sintering is dipped in a plating solution so as to form outer electrodes, a metal for plating grows on the surface of the magnetic material to which the inner electrodes are diffused, or the plating solution enters the magnetic material, so that the inner electrodes corrode. In addition, it also has the disadvantage in that the plating solution is exuded from the magnetic material after the plating, so that a substrate corrodes, for example.

SUMMARY OF THE INVENTION

An object of the present invention is to provide a solid inductor whose inductance value can be easily adjusted without changing the appearance thereof and which has resistance to humidity enhanced by improving its chip surface.

The solid inductor according to the present invention comprises a magnetic material formed of a ceramic body obtained by laminating green sheets, followed by cofiring, an inner conductor so provided as to pass through the magnetic material from one end to the other end, a pair of outer electrodes provided in both ends of the magnetic material so as to be electrically connected to both ends of the inner conductor, respectively, and a diffusion layer, which is formed by diffusion of a vitreous diffused material applied to the surface of the magnetic material into the magnetic material, exhibiting lower permeability than the magnetic material.

In the present invention, the magnetic material is formed of ceramics such as ferrite. It is possible to use as such ceramics Mn—Zn ferrite, Ni—Zn ferrite, Cu—Zn ferrite and the like.

In the present invention, the diffusion layer is formed by the diffusion of the vitreous diffused material applied to the surface of the magnetic material into the magnetic material. It is possible to use as the diffused material borosilicate zinc glass, lead borosilicate zinc glass, lead borosilicate glass, lead glass and the like. This diffused material is diffused into the magnetic material, to form structure which is low in permeability and is dense.

Such diffusion of the diffused material into the magnetic material can be carried out by, for example, heat treatment. The conditions for the heat treatment are generally 600° to 950° C. and 20 minutes to 3 hours, although suitably selected depending on, for example, materials of the magnetic material and the inner conductor used.

In the present invention, the inner conductor is so provided as to pass through the magnetic material from one end to the other end. The inner conductor may be formed on a straight line in the magnetic material or may be so provided as to form a coil in the magnetic material.

The inner conductor can be formed by forming an inner conductor in part of green sheets laminated so as to form a ceramic body and laminating the green sheets along with the other green sheets, followed by cofiring. It is possible to use as materials of the inner conductor a metal such as Ag or an alloy, such as Ag—Pd. It is possible to employ as a method of forming the inner conductor the coating process, the printing process, the sputtering process or the like. In addition, it is possible to employ a method of forming the green sheets so as to form the magnetic material the extrusion process, the printing process, the sheet process or the like.

According to the present invention, the diffusion layer formed by the diffusion of the vitreous diffused material exists in the vicinity of the surface of the magnetic material. This diffusion layer is structure which is lower in permeability that the magnetic material and is dense. Since the permeability of the diffusion layer is lower than that of the magnetic material, the inductance value of the solid inductor can be accurately adjusted by adjusting the thickness of the diffusion layer. The thickness of the diffusion layer can be adjusted by changing the type of diffused material, the heat-treating temperature, the heat-treating time and the like. According to the present invention, therefore, it is possible to accurately adjust the inductance value of the solid inductor without changing the external shape thereof. In addition, such formation of the diffusion layer can be accomplished simultaneously with respect to relatively large numbers of solid inductors, so that the productivity is superior.

Furthermore, the diffusion layer formed in the vicinity of the surface of the magnetic material according to the present invention is formed as dense structure. Therefore, the entrance of a plating solution or the like can be restrained, thereby to make it possible to prevent the corrosion of the inner electrodes, and the corrosion of a substrate, for example, due to the exudation of the plating solution from the solid inductor after the plating.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
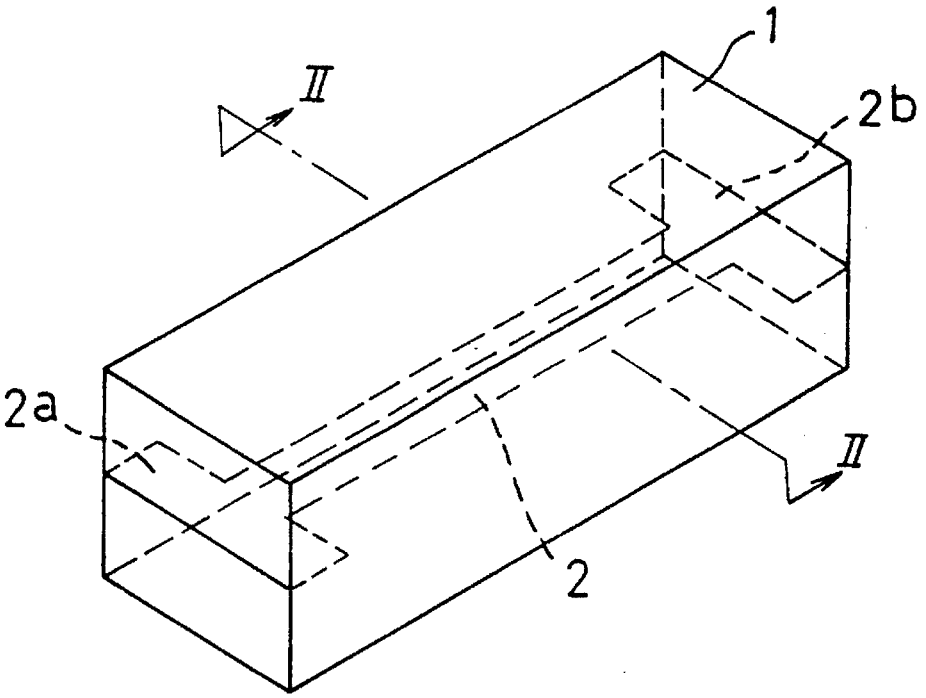
FIG. 1 is a perspective view showing a first embodiment of the present invention.
Figure 2:
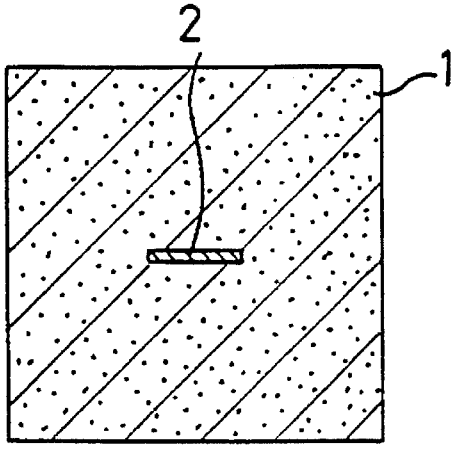
FIG. 2 is a cross sectional view taken along a line II—II shown in FIG. 1.

Referring to FIGS. 1 and 2, an inner conductor 2 is provided in a magnetic material 1. Wide ends 2*a* and 2*b* are respectively provided in both ends of the inner conductor 2, and the inner conductor 2 is so provided as to linearly pass through the magnetic material 1.

Figure 3:
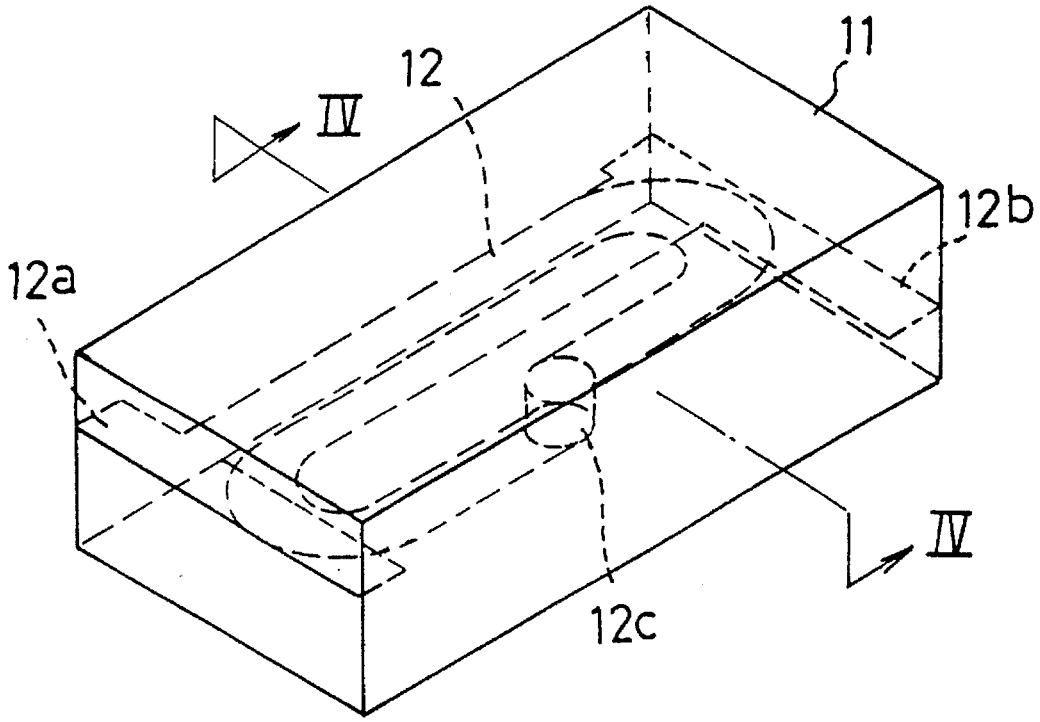
FIG. 3 is a perspective view showing a second embodiment of the present invention.
Figure 4:
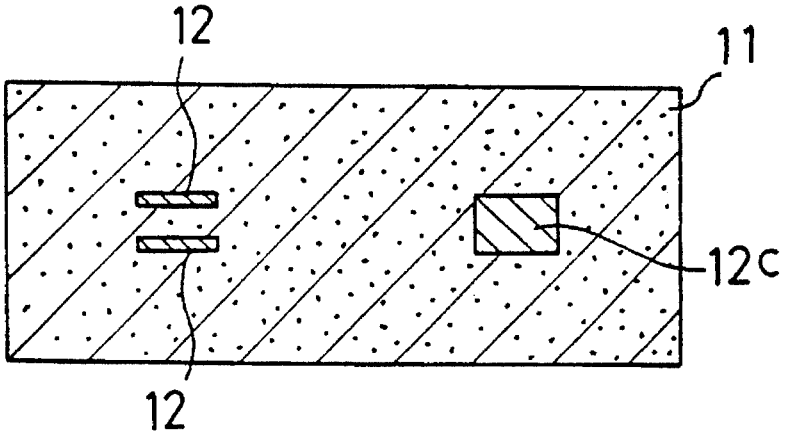
FIG. 4 is a cross sectional view taken along a line IV—IV shown in FIG. 3.

Referring to FIGS. 3 and 4, an inner conductor 12 is provided in a magnetic material 11, and the inner conductor 12 is so formed as to have a coil shape, in the present embodiment. The inner conductor 12 is formed by connecting upper and lower two layers by a through hole conductor 12*c*. A wide end 12*a* is formed in an end of the upper inner conductor 12, and the inner conductor 12 extends to the through hole conductor 12*c* from the end 12*a* in a U shape. The upper inner conductor 12 is connected to the lower inner conductor 12 in a part of the through hole conductor 12*c*, and the lower inner conductor 12 extends to the wide end 12*b* provided in the other end of the magnetic material 11 in a U shape.

Figure 5:
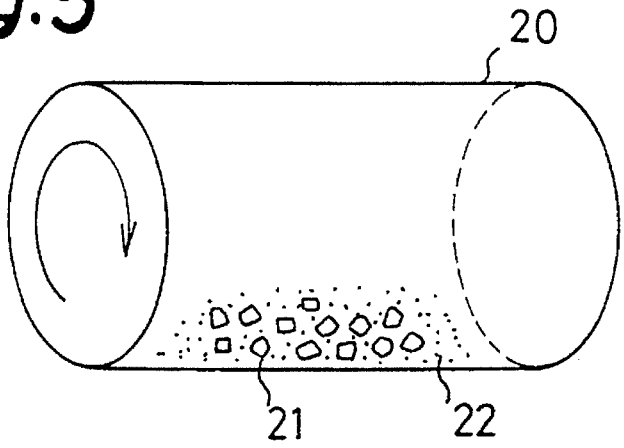
FIG. 5 is a perspective view for explaining the step of applying a diffused material to the surface of a chip ceramic body sintered and diffusing the diffused material by heat treatment.

Both the first embodiment shown in FIGS. 1 and 2 and the second embodiment shown FIGS. 3 and 4 describe a magnetic material in a state before a diffused material is applied to the surface of a magnetic material to form a diffusion layer. According to the present invention, the diffused material is applied! to the surface of the magnetic material and the diffused material is diffused into the magnetic material, to form the diffusion layer. FIG. 5 shows one example of apparatuses used for such diffusion processing of the diffused material. Referring to FIG. 5, a magnetic material 21 after sintering as shown in FIG. 1 or 3, along with a diffused material 22, is contained in a cylindrical container 20 made of alumina. Although the amount of addition of the diffused material 22 is suitably adjusted by the type of magnetic material used and the type of diffused material used, the set value of the thickness of the diffusion layer, and the like, the amount of the diffused material 22 is generally 0.1 to 4% by weight with respect to the weight of the magnetic material sintered. The cylindrical container 20 made of alumina is rotated in such a state, to heat-treat, while rotating and agitating the magnetic material 21 and the diffused material 22 in the container 20, the magnetic material 21 using the diffused material 22. By this heat treatment, the diffused material is applied to the surface of the magnetic material, and the diffused material is diffused into the magnetic material from the surface. The heat-treating temperature and the heat-treating time are generally 600° to 950° C. and 20 minutes to 3 hours, although suitably selected depending on the types of magnetic material and diffused material used, the predetermined thickness of the diffusion layer, and the like.

Figure 6:
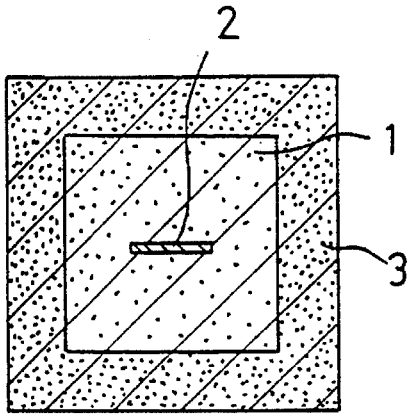
FIG. 6 is a cross sectional view showing a state after a diffusion layer is formed in the first embodiment of the present invention.
Figure 8:
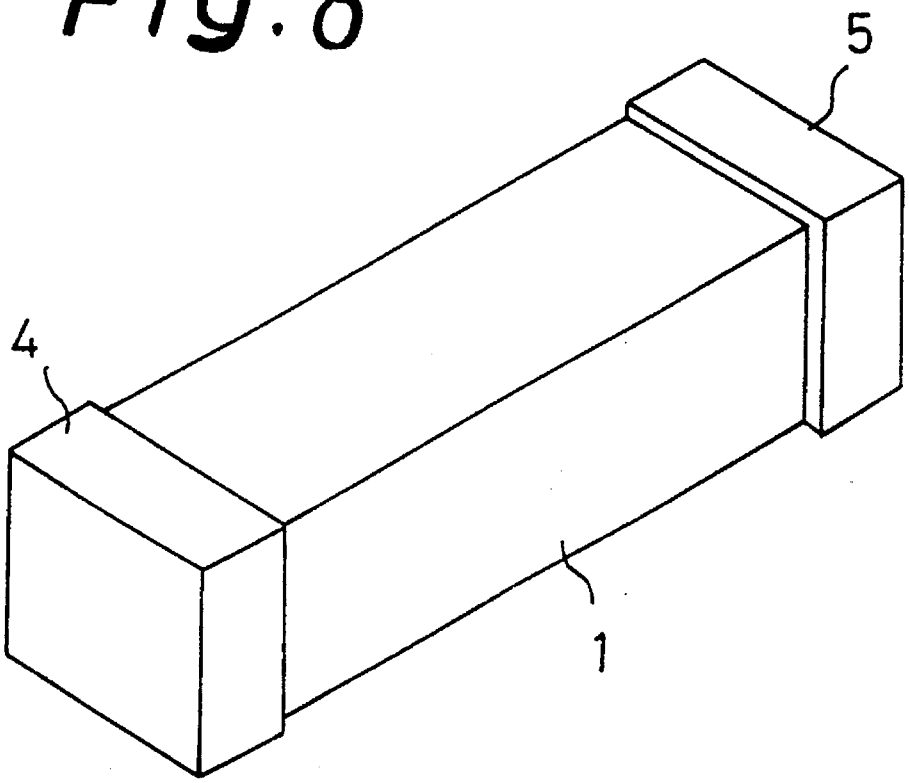
FIG. 8 is a perspective view showing a state after outer electrodes are formed in the first embodiment of the present invention.

FIG. 8 is a cross sectional view showing a state of a solid inductor after a diffused material applied to the surface of a magnetic material is diffused to form a diffusion layer in the magnetic material. Referring to FIG. 6, diffusion layer 3 is formed in the vicinity of the surface of the magnetic material 1. This diffusion layer 3 is formed as a result of diffusing a vitreous diffused material into the magnetic material, and has low permeability and is formed as dense structure. Consequently, the inductance value of the solid inductor can be adjusted by the thickness of the diffusion layer 3. The thickness of the diffusion layer 3 can be adjusted by the type of diffused material and the amount of the diffused material, the heat-treating temperature and the heat-treating time, and the like. In addition, the diffusion layer 3 has dense structure, so that the entrance of a plating solution or the like from the exterior can be prevented, to give superior resistance to humidity to the solid inductor.

Figure 7:
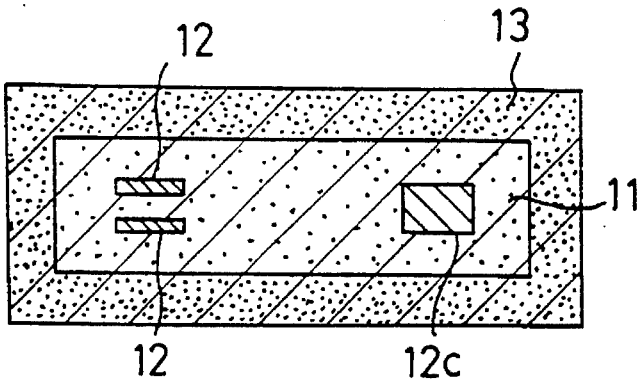
FIG. 7 is a cross sectional view showing a state after a diffusion layer is formed in the second embodiment of the present invention.

FIG. 7 is a cross sectional view showing a state of a solid inductor after a diffusion layer is formed in the second embodiment of the present invention. Referring to FIG. 7, a diffusion layer 13 is formed in the vicinity of the surface of a magnetic material 11.

After the diffusion layer is thus formed in the magnetic material, outer electrodes electrically connected to ends of an inner conductor are formed in both ends of the magnetic material. FIG. 8 shows a state where outer electrodes are formed in the first embodiment of the present invention. Referring to FIG. 8, outer electrodes 4 and 5 are formed in both ends of the magnetic material 1. The outer electrode 4 is electrically connected to the end 2*a* of the inner conductor shown in FIG. 1, and the outer electrode 5 is electrically connected to the other end 2*b* thereof.

Figure 9:
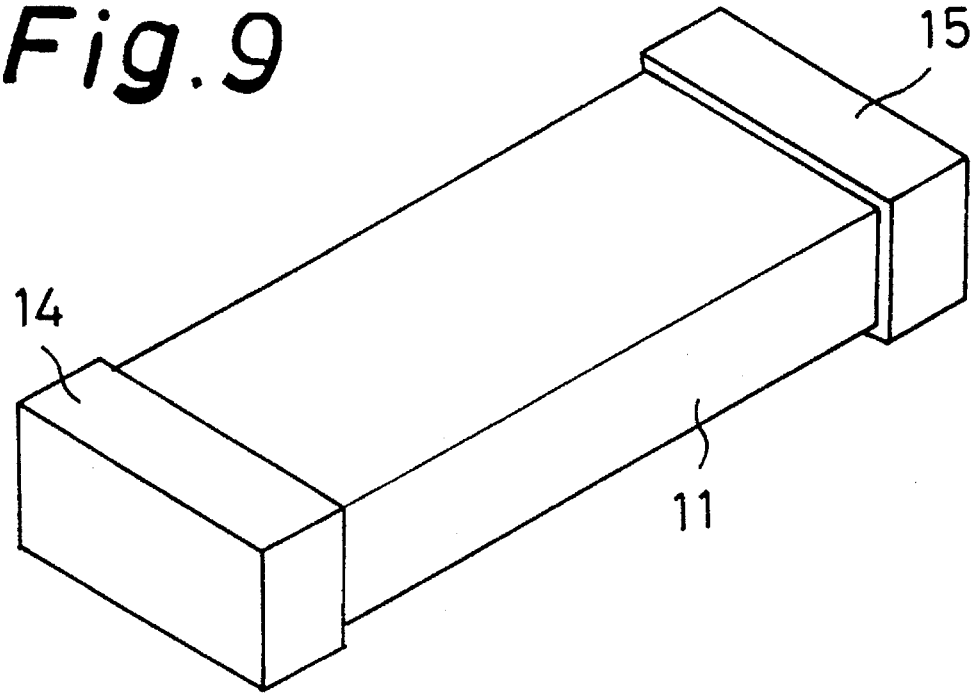
FIG. 9 is a perspective view showing a state after outer electrodes are formed in the second embodiment of the present invention.

FIG. 9 shows a state where outer electrodes 14 and 15 are formed in both ends of the magnetic material 11 in the second embodiment. Similarly in the present embodiment, the outer electrode 14 is electrically connected to the end 12*a* of the inner conductor, and the outer electrode 15 is electrically connected to the other end 12*b* thereof. The outer electrodes can be made of Ag (Ag—Pd). In the present invention, the outer electrodes are formed by applying conductive paste, followed by baking.

Description is now made of more concrete examples of the present invention.

A solid inductor according to the first embodiment of the present invention as shown in FIG. 1 is fabricated using Ni—Zn—Cu ferrite having permeability 250 μi as magnetic ceramics. Green sheets made of the ferrite are first formed, and Ag—Pd is applied to part of the green sheets by the printing process, to form an inner conductor 2 as shown in FIG. 1. The green sheets, along with the other green sheets, are laminated and are formed by the pressing process. A formed body obtained is sintered at a temperature of 900° C., to obtain a magnetic material as shown in FIGS. 1 and 2.

This magnetic material, along with a diffused material, is contained in a cylindrical container made of alumina as shown in FIG. 5, to be heat-treated while rotating the container in air.

Four types of glass A, B, C and D such as borosilicate zinc glass as described below are used as the diffused material. The amount of the diffused material is 1.5% by weight of a magnetic chip sintered.

Glass A: $ZnO—B_2O_3—SiO_2$ glass

Glass B: $PbO—B_2O_3—ZnO—SiO_2$ glass

Glass C: $PbO—B_2O_3—SiO_2$ glass

Glass D: $PbO—SiO_2$ glass

Meanwhile, the external dimensions of the magnetic chip sintered are 1.0 by 1.0 by 2.0 mm, and the dimensions of the inner conductor are 100 μm wide by 10 μm thick.

The conditions for heat treatment, that is, the heat-treating temperature and the heat-treating time are set as shown in Table 1. A diffusion layer is formed under each of the conditions for heat treatment and then, outer electrodes are formed by baking as shown in FIG. 8, to obtain a solid inductor.

The inductance value L of the inductor in each of examples obtained is measured.

Furthermore, a solid inductor in which no diffused material is applied to the surface of a magnetic material and the magnetic material is not heat-treated is fabricated as a comparative example. The inductance value $L_0$ of the solid inductor in the comparative example is 302.7 nH.

The rate of change of the inductance value L in each of the above described examples with respect to the inductance value $L_0$ in the comparative example is calculated as 100 $(L_0-L)/L_0$. The results are shown in Table 1.

[TABLE 1]

| | | Heat Treatment Conditions [Temperature (°C.)/Time (hr)] | | | | |
|---|---|---|---|---|---|---|
| | | 750/0.5 | 850/0.5 | 850/1.5 | 850/3.0 | 950/3.0 |
| Glass A | L (nH) | 284.1 | 273.7 | 247.8 | 209.6 | 141.4 |
| | $(L-L_0)/L_0$ (%) | −6.1 | −9.6 | −18.1 | −30.8 | −53.3 |
| Glass B | L (nH) | 284.5 | 274.6 | 249.8 | 213.1 | 147.5 |
| | $(L-L_0)/L_0$ (%) | −6.0 | −9.3 | −17.5 | −29.6 | −51.3 |
| Glass C | L (nH) | 286.2 | 278.3 | 258.4 | 228.3 | 174.1 |
| | $(L-L_0)/L_0$ (%) | −5.5 | −8.1 | −14.6 | −24.6 | −42.5 |
| Glass D | L (nH) | 289.4 | 285.1 | 273.9 | 256.0 | 223.0 |
| | $(L-L_0)/L_0$ (%) | −4.4 | −5.8 | −9.5 | −15.4 | −26.3 |

As can be seen from the results of the table 1, a solid inductor in which a vitreous diffused material is diffused into a magnetic material to form a diffusion layer according to the present invention varies in inductance value. Furthermore, the rate of change in the inductance value can be further adjusted by the heat-treating temperature and the heat-treating time. According to the present invention, therefore, it is possible to adjust the inductance value easily and accurately. Particularly as apparent from the results of the table 1, when borosilicate zinc glass such as glass A and glass B is used, a large rate of change in inductance is obtained even at a low heat-treating temperature. The reason for this is probably that the borosilicate zinc glass is easily diffused into the magnetic material even at a low heat-treating temperature, so that the density of a sintered body is high.

Additionally, as a result of observing the corrosion of inner electrodes in a case where the solid inductors in which a diffusion layer is formed in the above described examples and the solid inductor in which no diffusion layer is formed in the comparative example are dipped into a plating solution and the corrosion of a substrate due to the exudation of the plating solution after the plating, corrosion is observed in the inner electrodes and the substrate in the solid inductor in the comparative example, while such corrosion is not recognized in the solid inductors in the examples according to the present invention. From this point, the solid inductor according to the present invention has superior resistance to humidity, to prevent the corrosion of the inner electrodes, the corrosion of the substrate, and the like which have been conventionally problems.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a solid inductor comprising the steps of:

laminating and cofiring green sheets of a magnetic material to form a ceramic body having two ends;

passing an inner conductor through said ceramic body from one end to the other end;

placing a pair of outer electrodes on both ends of said ceramic body and electrically connecting said outer electrodes to respective ends of said inner conductor; and applying a vitreous material exhibiting lower permeability than the magnetic material to the surface of said magnetic material, and diffusing said vitreous material into the magnetic material, thereby forming a diffusion layer.

2. The method according to claim 1, wherein said magnetic material is ferrite.

3. The method according to claim 1, wherein said magnetic material is selected from the group consisting of Mn—Zn ferrite, Ni—Zn ferrite, and Cu—Zn ferrite.

4. The method according to claim 1, wherein said diffused material is borosilicate zinc glass.

5. The method according to claim 1, wherein said diffused material is lead borosilicate zinc glass.

6. The method according to claim 1, wherein said diffused material is lead borosilicate glass.

7. The method according to claim 1, wherein said diffused material is lead glass.

8. The method according to claim 1, further comprising the step of heat-treating said diffused material which forms said diffusion layer.

9. The method according to claim 8, wherein the heat-treating step is carried out at a temperature in the range of 600° to 950° C., and for a heat-treating time of 20 minutes to 3 hours.

10. The method according to claim 1, comprising the step of forming said inner conductor linearly in the magnetic material.

11. The method according to claim 1, comprising the step of forming said inner conductor in the shape of a coil in the magnetic material.

12. The method according to claim 1, comprising the step of forming said inner conductor on a selected one of said green sheets and laminating and cofiring said selected green sheet with others of said green sheets having no inner conductor thereon.

13. The method according to claim 12, further comprising the step of additionally forming said inner conductor on a second selected one of said green sheets.

* * * * *